US009628927B2

(12) United States Patent
Chen et al.

(10) Patent No.: US 9,628,927 B2
(45) Date of Patent: Apr. 18, 2017

(54) AUDIO INTERFACE CIRCUIT

(71) Applicant: ASUSTeK COMPUTER INC., Taipei (TW)

(72) Inventors: Pei-Yuan Chen, Taipei (TW); Chyi-Cheng Wang, Taipei (TW); Chao-Liang Hung, Taipei (TW); Shuo-Wen Chang, Taipei (TW); Sheng-Ta Lin, Taipei (TW)

(73) Assignee: ASUSTeK COMPUTER INC., Taipei (TW)

( * ) Notice: Subject to any disclaimer, the term of this patent is extended or adjusted under 35 U.S.C. 154(b) by 0 days.

(21) Appl. No.: 15/064,605

(22) Filed: Mar. 9, 2016

(65) Prior Publication Data

US 2016/0269813 A1 Sep. 15, 2016

(30) Foreign Application Priority Data

Mar. 13, 2015 (TW) ..... 104108117 A

(51) Int. Cl.
*H04R 29/00* (2006.01)
*H04R 3/00* (2006.01)

(52) U.S. Cl.
CPC ..... *H04R 29/001* (2013.01); *H04R 3/007* (2013.01); *H04R 29/004* (2013.01); *H04R 2420/05* (2013.01)

(58) Field of Classification Search
CPC ..... H03G 9/14; H03G 3/3026; H03G 3/3089; H03G 3/3031; H04B 1/3827; H04R 12/723; H04R 24/58
USPC ..... 439/607.35, 78; 455/90.2
See application file for complete search history.

(56) References Cited

U.S. PATENT DOCUMENTS

| | | | | |
|---|---|---|---|---|
| 6,093,058 | A * | 7/2000 | Wu | H01R 24/58 439/607.35 |
| 8,724,824 | B2 | 5/2014 | Wu | |
| 2004/0175993 | A1 | 9/2004 | Chennakeshu | |
| 2015/0263443 | A1* | 9/2015 | Zhang | H01R 12/72 439/78 |
| 2015/0280678 | A1* | 10/2015 | Teh | H03G 9/14 455/90.2 |

FOREIGN PATENT DOCUMENTS

| | | |
|---|---|---|
| CN | 102480663 | 5/2012 |
| CN | 203826606 | 9/2014 |
| WO | 2012031481 | 3/2012 |

* cited by examiner

*Primary Examiner* — Mohammad Islam
(74) *Attorney, Agent, or Firm* — Jiang Chyun IP Office

(57) ABSTRACT

An audio interface circuit including a processor, an audio jack, a first filter circuit, a second filter circuit, a first clamp circuit, a second clamp circuit, a third filter circuit, and a fourth filter circuit is provided. A first clamp circuit and a second clamp circuit between a third and fourth electrodes and a processor, so that the third and fourth electrodes are allowed to be coupled to a microphone.

16 Claims, 3 Drawing Sheets

AUDIO INTERFACE CIRCUIT

CROSS-REFERENCE TO RELATED APPLICATION

This application claims the priority benefit of Taiwan application serial No. 104108117, filed on Mar. 13, 2015. The entirety of the above-mentioned patent application is hereby incorporated by references herein and made a part of specification.

BACKGROUND OF THE INVENTION

Field of the Invention

The invention relates to an interface circuit and, more specifically, to an audio interface circuit.

Description of the Related Art

Conventionally, an audio jack of an electrical device serves as a audio interface for outputting/inputting sound. However, since audio connectors have different sizes, and the numbers of electrodes and functions are also different, the audio jacks are not universal. Therefore, multiple connecting seats are needed for different audio connectors.

BRIEF SUMMARY OF THE INVENTION

According to a first aspect of the present disclosure, an audio interface circuit comprises: a processor for processing audio signal; an audio jack, including a first electrode, a second electrode, a third electrode and a fourth electrode, wherein the second electrode is coupled to a first input end of the processor, the first electrode is coupled to a second input end of the processor; a first filter circuit coupled between the third electrode and a first output end of the processor; a second filter circuit coupled between the fourth electrode and a second output end of the processor; a first ground circuit coupled to the first electrode and a ground control end of the processor to receive a ground enabling signal, and a ground voltage is provided to the first electrode according to the ground enabling signal; a first bias circuit coupled to a first voltage output end of the processor to receive a first reference voltage, and coupled to the first electrode and the second electrode to provide the first reference voltage to the first electrode and the second electrode; a first current limiting circuit coupled to a second voltage output end of the processor to receive a second reference voltage, and coupled to the third electrode to provide the second reference voltage to the third electrode; a second current limiting circuit coupled to a third voltage output end of the processor to receive a third reference voltage, and coupled to the fourth electrode to provide the third reference voltage to the fourth electrode; a third filter circuit coupled to the third electrode and a third input end of the processor; and a fourth filter circuit coupled to the fourth electrode and a fourth input end of the processor.

In sum, an audio interface circuit is provided with a first current limiting circuit and a second current limiting circuit between the third and fourth electrodes and the processor respectively, so that the third and fourth electrodes can be coupled to a microphone. Thus, the universality of the audio connector is enhanced.

BRIEF DESCRIPTION OF THE DRAWINGS

These and other features, aspects and advantages of the invention will become better understood with regard to the following embodiments and accompanying drawings.

DETAILED DESCRIPTION OF THE EMBODIMENTS

Figure 1A:
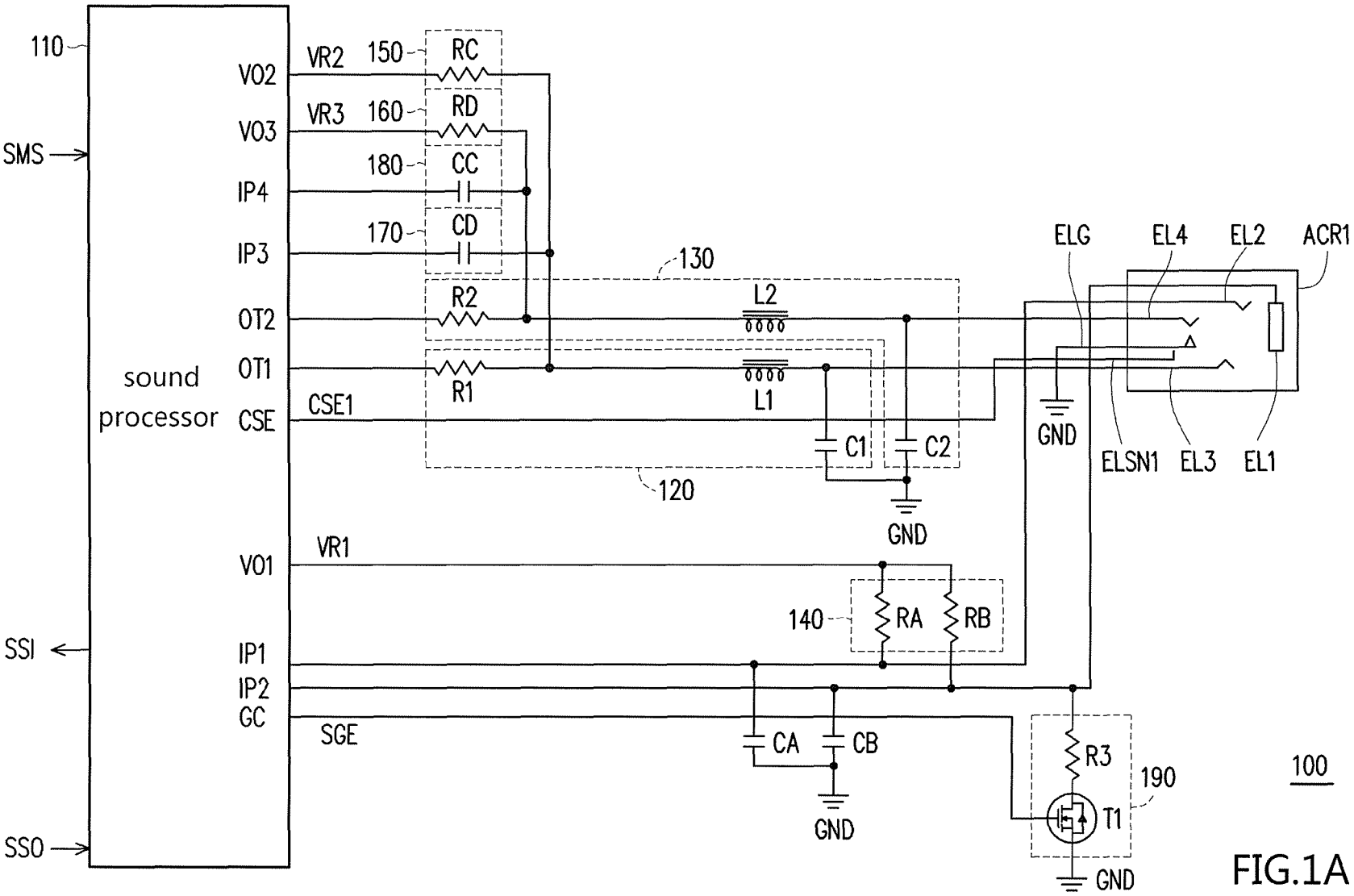
FIG. 1A is a schematic view showing an audio interface circuit in an embodiment.

FIG. 1A is a schematic view showing an audio interface circuit in an embodiment. Referring to FIG. 1A, in the embodiment, an audio interface circuit 100 includes a processor 110, a first filter circuit 120, a second filter circuit 130, a first bias circuit 140, a first current limiting circuit 150, a second current limiting circuit 160, a third filter circuit 170, a fourth filter circuit 180, a first ground circuit 190, an audio jack ACR1 and capacitors CA and CB.

The audio jack ACR1 includes a first electrode EL1, a second electrode EL2, a third electrode EL3, a fourth electrode EL4, a first connection detecting electrode ELSN1 and a ground electrode ELG. That is, in the embodiment, the audio jack ACR1 is a 4-ring jack. In the embodiment, the first electrode EL1 is coupled to a second input end IP2 of the processor 110, and the second electrode EL2 is coupled to a first input end IP1 of the processor 110, to connect with a microphone of a headset. The ground electrode ELG receives a ground voltage GND. The first connection detecting electrode ELSN1 provides a first detecting signal SSE1 to a connection detecting end CSE of the processor 110. The capacitors CA and CB are coupled to the second electrode EL2 and the first electrode EL1, respectively.

The first filter circuit 120 is coupled between the third electrode EL3 and a first output end OT1 of the processor 110. The first filter circuit 120 includes, but not limited into, a first resistor R1, a first inductor L1 and a first capacitor C1. The first inductor L1 and the first resistor R1 are connected in series between the first output end OT1 of the processor 110 and the third electrode EL3. The first capacitor C1 is coupled between the third electrode EL3 and the ground voltage GND. In the embodiment, the first filter circuit 120 is a low pass filter.

The second filter circuit 130 is coupled between the fourth electrode EL4 and a second output end OT2 of the processor 110. The second filter circuit 130 includes, but not limited into, a second resistor R2, a second inductor L2 and a second capacitor C2. The second inductor L2 and the second resistor R2 are connected in series between the second output end OT2 and the fourth electrode EL4, the second capacitor C2 is coupled between the fourth electrode EL4 and the ground voltage GND. In the embodiment, the second filter circuit 130 is a low pass filter.

The first bias circuit 140 is coupled to a first voltage output end VO1 of the processor 110 to receive a first reference voltage VR1. The first bias circuit 140 is coupled to the first electrode EL1 and the second electrode EL2 to provide the first reference voltage VR1 to the first electrode EL1 and the second electrode EL2. The first bias circuit 140 includes, but not limited to, resistors RA and RB. In the embodiment, the resistor RA is coupled between the first voltage output end VO1 of the processor 110 and the second electrode EL2, the resistor RB is coupled between the first voltage output end VO1 of the processor 110 and the first electrode EL1.

The first current limiting circuit 150 is coupled to a second voltage output end VO2 of the processor 110 to receive a second reference voltage VR2. The first current limiting circuit 150 is coupled to third electrode EL3 via the first filter circuit 120 to provide the second reference voltage VR2 to the third electrode EL3. The first current limiting circuit 150 includes, but not limited to, a resistor RC. The resistor RC is coupled between the second voltage output end VO2 of the processor 110 and the third electrode EL3.

The second current limiting circuit 160 is coupled to a third voltage output end VO3 of the processor 110 to receive a third reference voltage VR3. The second current limiting circuit 160 is coupled to the fourth electrode EL4 via the second filter circuit 130 to provide a third reference voltage VR3 to the fourth electrode EL4. The second current limiting circuit 160 includes, but not limited to, a resistor RD. The resistor RD is coupled between the third voltage output end VO3 of the processor 110 and the fourth electrode EL4.

The third filter circuit 170 is coupled between the third electrode EL3 and a third input end IP3 of the processor 110. The third filter circuit 170 includes, but not limited to, a capacitor CC. The capacitor CC is coupled between the third input end IP3 and the third electrode EL3. The fourth filter circuit 180 is coupled between the fourth electrode EL4 and a fourth input end IP4 of the processor 110. The fourth filter circuit 180 includes, but not limited into, a capacitor CD. The capacitor CD is coupled between the fourth input end IP4 of the processor 110 and the fourth electrode EL4.

The first ground circuit 190 is coupled to the first electrode EL1 and a ground control end GC of the processor 110 to receive a ground enabling signal SGE, and providing a ground voltage GND to the first electrode EL1 according to the ground enabling signal SGE. The first ground circuit 190 includes, but not limited to, a third resistor R3 and a first transistor T1. The third resistor R3 is coupled between the first electrode EL1 and a drain electrode of the first transistor T1 (corresponding to a first end). A gate electrode of the first transistor T1 (corresponding to a control end) receives the ground enabling signal SGE, and a source electrode of the first transistor T1 (corresponding to a second end) receives the ground voltage GND.

In the embodiment, when the audio connector (not shown) is not inserted into the audio jack ACR1, the first connection detecting electrode ELSN1 and the ground electrode GND are electrically isolated. When the audio connector (not shown) is inserted into the audio jack ACR1, the first connection detecting electrode ELSN1 and the ground electrode GND is electrically connected. In the embodiment, the audio jack ACR1 is a normally open audio jack, and the processor 110 provides the ground enabling signal SGE according to the first detecting signal CSE1. In other words, the processor 110 determines whether the audio connector (not shown) is inserted into the audio jack ACR1 according to the voltage change of the first detecting signal CSE1, and then a corresponding voltage level of the ground enabling signal SGE is set. When the audio connector (not shown) is not inserted into the audio jack ACR1, the processor 110 would not conduct the first ground circuit 190. The processor 110 conducts the first ground circuit 190, when the audio connector (not shown) is inserted into the audio jack ACR1.

On the other hand, the processor 110 receives a mode setting signal SMS to set the operating mode for the audio interface circuit 100 according to the mode setting signal SMS. In the embodiment, when the mode setting signal SMS corresponds to a headset mode, the second electrode EL2 is disconnected, the third electrode EL3 and the fourth electrode EL4 are coupled to the headset. At the time, the first output end OT1 and the second output end OT2 are enabled by the processor 110, and the first voltage output end VO1, the second voltage output end VO2, the third voltage output end VO3, the first input end IP1, the second input end IP2, the third input end IP3 and the fourth input end IP4 are disabled by the processor 110. After the processor 110 receives an audio output signal SSO, the processor 110 determines the voltage levels at the first output end OT1 and the second output end OT2 according to the audio output signal SSO to drive the headset to output a corresponding audio.

When the mode setting signal SMS corresponds to a headset microphone mode, the second electrode EL2 is coupled to the microphone, and the third electrode EL3 and the fourth electrode EL4 are coupled to the headset. In the embodiment, the first output end OT1, the second output end OT2, the first voltage output end VO1, the first input end IP1 and the second input end IP2 are enabled by the processor 110, and the second voltage output end VO2, the third voltage output end VO3, the third input end IP3 and the fourth input end IP4 are disabled by the processor 110. Then, the processor 110 provides an audio input signal SSI according to the voltage levels at the first input end IP1 and the second input end IP2. After the processor 110 receives the audio output signal SSO, the processor 110 drives the headset to output an audio according to the audio output signal SSO.

When the mode setting signal SMS corresponds to a microphone mode, the second electrode EL2 is disconnected, the third electrode EL3 and the fourth electrode EL4 are coupled to a microphone. At the time, the second voltage output end VO2, the third voltage output end VO3, the third input end IP3 and the fourth input end IP4 are enabled by the processor 110, and the first output end TO1, the second output end TO2, the first voltage output end VO1, the first input end IP1 and the second input end IP2 are disabled by the processor 110. Then, the processor 110 provides an audio input signal SSI according to the voltage levels at the second input end IP3 and the fourth input end IP4. In an embodiment, the second reference voltage VR2 is the same as the third reference voltage VR3. In another embodiment, the second reference voltage VR2 is different from the third reference voltage VR3.

In the microphone mode, the second reference voltage VR2 and the third reference voltage VR3 are provided to the third electrode EL3 and the fourth electrode EL4 via the first current limiting circuit 150 and the second current limiting circuit 160, respectively. If a headset is inserted at the time, a large direct current may burn the headset. Therefore, the resistance values of the resistors RC and RD in the first current limiting circuit 150 and the second current limiting circuit 160 are adjusted to make the current values through the first current limiting circuit 150 and the second current limiting circuit 160 equal to or less than a rated current of the headset, and then the headset would not be burn.

Figure 1B:
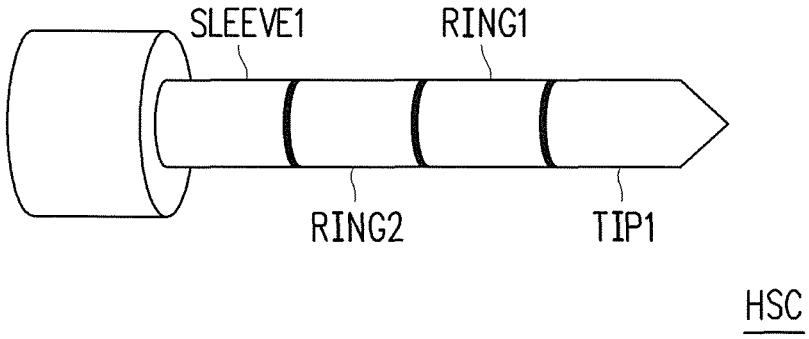
FIG. 1B is a schematic view showing a connector structure of a headset microphone in an embodiment.

FIG. 1B is a schematic view showing a connector structure of a headset microphone in an embodiment. Referring to FIG. 1A and FIG. 1B, in the embodiment, a connector HSC of a headset microphone includes a tip TIP1, metal rings RING1, RING2 and a sleeve SLEEVE1. That is, in the embodiment, the connector HSC is an audio connector with four rings. When the connector HSC is inserted into the audio jack ACR1, the sleeve SLEEVE1 is electrically connected with the first electrode ELI to receive a ground voltage GND, the metal ring RING1 is electrically connected with the third electrode EL3 to transmit an audio output signal in a right channel, the metal ring RING2 is electrically connected with the second electrode EL2 to receive a mono signal from the microphone, and the tip TIP1 is electrically connected with the fourth electrode EL4 to transmit an audio output signal in a left channel. In other words, in the embodiment, the connector HSC complies with OMTP (Open Mobile Terminal Platform) standard. In another embodiment, the connector HSC complies with CITA (Cellular Telecommunications Industry Association) standard, and the first ground circuit 190 is coupled to the second electrode EL2, in this case, the sleeve SLEEVE1 is electrically connected with the first electrode EL1 to receive the mono signal from the microphone, the metal ring RING2 is electrically connected with the second electrode EL2 to receive the ground voltage GND.

Figure 1C:
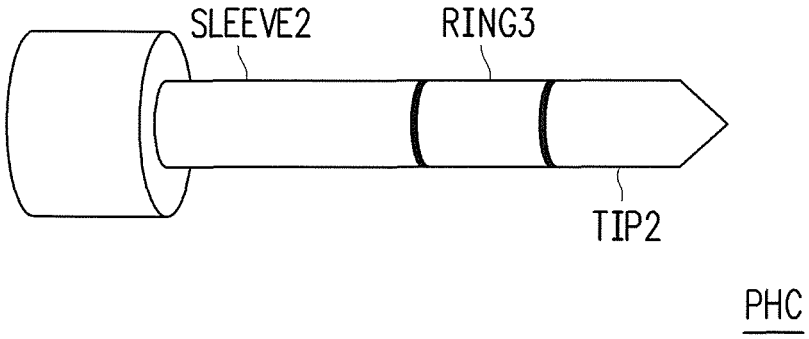
FIG. 1C is a schematic view showing a connector structure of a headset in an embodiment.

FIG. 1C is a schematic view showing a connector structure of a headset in an embodiment. Referring to FIG. 1A and FIG. 1C, in the embodiment, a connector PHC of a headset includes a tip TIP2, a metal ring RNG3 and a sleeve SLEEVE2. That is, in the embodiment, the connector HSC is an audio connector with three rings. When the connector PHC is inserted into the audio jack ACR1, the sleeve SLEEVE2 is electrically connected with the first electrode EL1 and the second electrode EL2 to receive a ground voltage GND, the metal ring RING3 is electrically connected with the third electrode EL3 to transmit an audio output signal in a right channel, and the tip TIP2 is electrically connected with the fourth electrode EL4 to transmit a audio output signal in a left channel.

Figure 1D:
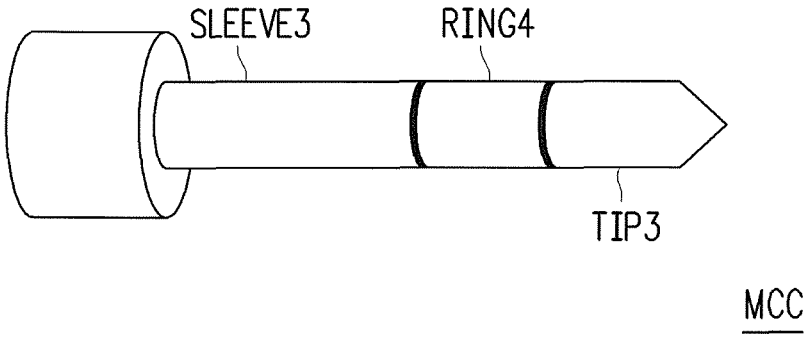
FIG. 1D is a schematic view showing a connector structure of a microphone in an embodiment.

FIG. 1D is a schematic view showing a connector structure of a microphone in an embodiment. Referring to FIG. 1A and FIG. 1D, in the embodiment, a connector MCC of a microphone includes a tip TIP3, a metal ring RING4 and a sleeve SLEEVE3. That is, in the embodiment, the connector MCC is also an audio connector with three rings. When the connector MCC is inserted into the audio jack ACR1, the sleeve SLEEVE3 is electrically connected with the first electrode EL1 and the second electrode EL2 to receive a ground voltage GND, the metal ring RING4 is electrically connected with the third electrode EL3 to receive an audio input signal in a right channel, and the tip TIP3 is electrically connected with the fourth electrode EL4 to receive an audio input signal in a left channel.

Figure 2:
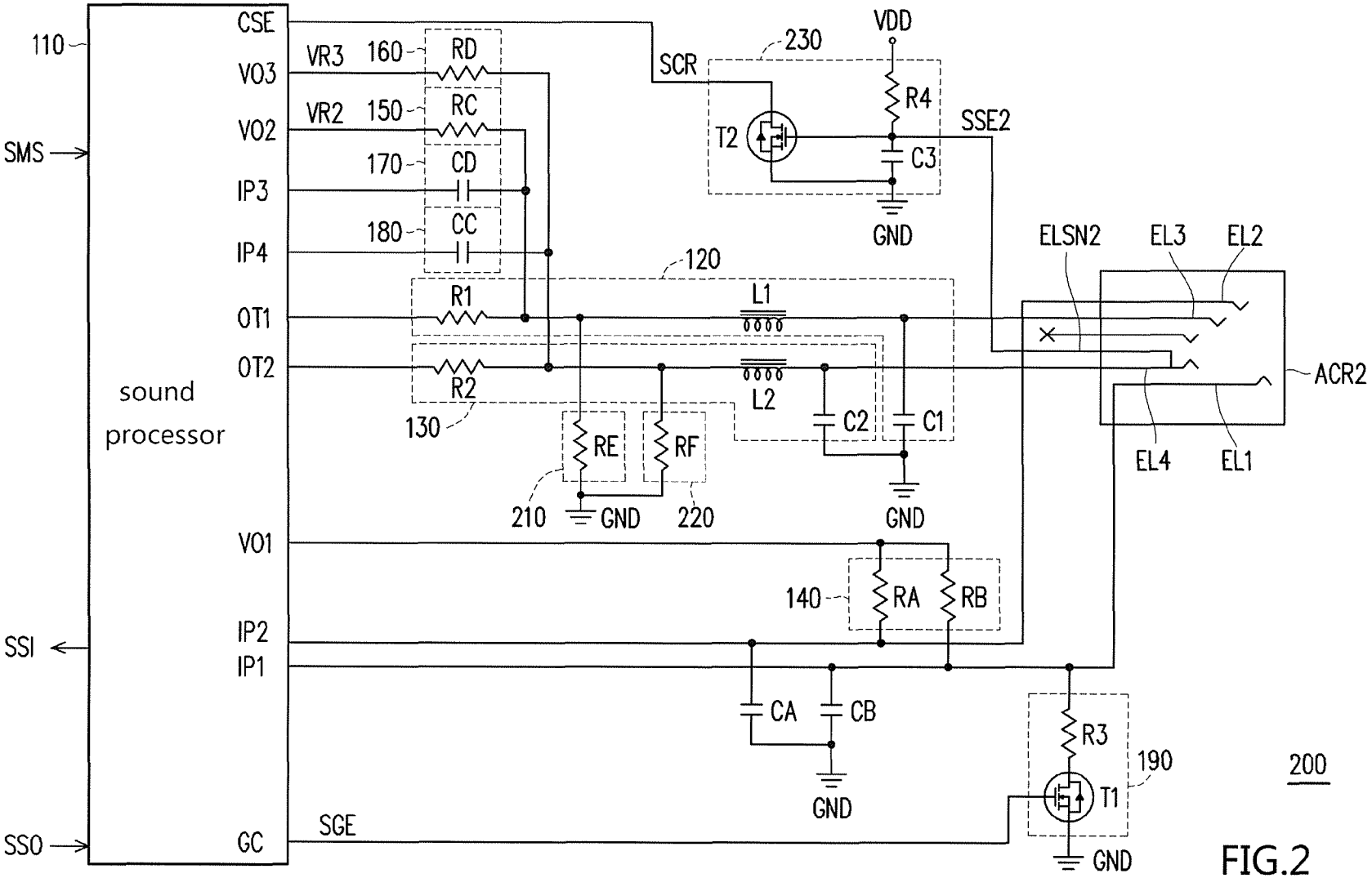
FIG. 2 is a schematic view showing an audio interface circuit in another embodiment.

FIG. 2 is a schematic view showing an audio interface circuit in another embodiment. Referring to FIG. 1A and FIG. 2, an audio interface circuit 200 is similar to the audio interface circuit 100, except an audio jack ACR2, a second ground circuit 210, a third ground circuit 220 and a voltage conversion circuit 230. The same or similar number denotes the same or similar components.

In the embodiment, the second ground circuit 210 is coupled between a third electrode EL3 of the audio jack ACR2 and a ground voltage GND via the first filter circuit 120. The third ground circuit 220 is coupled between a fourth electrode EL4 of the audio jack ACR2 and the ground voltage GND via the second filter circuit 130. In the embodiment, the second ground circuit 210 includes, but not limited to, a resistor RE. The resistor RE is coupled between the third electrode EL3 and the ground voltage GND. The third ground circuit 220 includes, but not limited into, a resistor RF. The resistor RF is coupled between the fourth electrode EL4 and the ground voltage GND.

The audio jack ACR2 includes a first electrode EL1, a second electrode EL2, the third electrode EL3, the fourth electrode EL4 and a second connection detecting electrode ELSN2. That is, in the embodiment, the audio jack ACR2 is also a 4-ring audio jack. Details for the first electrode EL1, the second electrode EL2, the third electrode EL3 and the fourth electrode EL4 can be referred to the embodiment in FIG. 1A, which is omitted here. When the audio connector (not shown) is not inserted into the audio jack ACR2, the second connection detecting electrode ELSN2 and the third electrode EL3 are electrically connected. When the audio connector (not shown) is inserted into the audio jack ACR2, the second connection detecting electrode ELSN2 and the third electrode EL3 are electrically isolated. In other words, in the embodiment, the audio jack ACR2 is a normally closed audio jack.

In the embodiment, the second connection detecting electrode ELSN2 is used for providing a second detecting signal SSE2. The voltage conversion circuit 230 is coupled to the second connection detecting electrode ELSN2 to receive the second detecting signal SSE2. The voltage conversion circuit 230 is coupled to the connection detecting end CSE of the processor 110 to provide a connecting reference signal SCR to the connection detecting end CSE. In the embodiment, the processor 110 provides a ground enabling signal SGE according to the connecting reference signal SCR. That is, the processor 110 provides the ground enabling signal SGE according to the second detecting signal SSE2.

In the embodiment, the voltage conversion circuit 230 includes a second transistor T2, a fourth resistor R4 and a third capacitor C3. A drain electrode of the second transistor T2 (corresponding to a first end) provides the connecting reference signal SCR, a source electrode of the second transistor T2 (corresponding to a second end) receives the ground voltage GND, and a gate electrode of the second transistor T2 (corresponding to the control end) receives the second detecting signal SSE2. The fourth resistor R4 is coupled between a system voltage VDD and the gate electrode of the second transistor T2. The third capacitor C3 is coupled between the gate electrode of the second transistor T2 and the ground voltage GND.

In sum, an audio interface circuit is provided with a first current limiting circuit and a second current limiting circuit among a third and fourth electrodes and a processor, so that the third and fourth electrodes are coupled to a microphone. In this way, the universality of the audio socket is enhanced. Furthermore, the currents through the first current limiting circuit and second current limiting circuit are adjusted to be less than a rated current of the headset to prevent the burning of the headset when the headset is mistakenly inserted.

Although the invention includes been disclosed with reference to certain embodiments thereof, the disclosure is not for limiting the scope. Persons having ordinary skill in the art may make various modifications and changes without departing from the scope of the invention. Therefore, the scope of the appended claims should not be limited to the description of the embodiments described above.

What is claimed is:

1. An audio interface circuit, comprising:

a processor for processing audio signal;

an audio jack, including a first electrode, a second electrode, a third electrode and a fourth electrode, wherein the second electrode is coupled to a first input end of the processor, the first electrode is coupled to a second input end of the processor;

a first filter circuit coupled between the third electrode and a first output end of the processor;

a second filter circuit coupled between the fourth electrode and a second output end of the processor;

a first ground circuit coupled to the first electrode and a ground control end of the processor to receive a ground enabling signal, and a ground voltage is provided to the first electrode according to the ground enabling signal;

a first bias circuit coupled to a first voltage output end of the processor to receive a first reference voltage, and coupled to the first electrode and the second electrode to provide the first reference voltage to the first electrode and the second electrode;

a first current limiting circuit coupled to a second voltage output end of the processor to receive a second reference voltage, and coupled to the third electrode to provide the second reference voltage to the third electrode;

a second current limiting circuit coupled to a third voltage output end of the processor to receive a third reference voltage, and coupled to the fourth electrode to provide the third reference voltage to the fourth electrode;

a third filter circuit coupled to the third electrode and a third input end of the processor; and a fourth filter circuit coupled to the fourth electrode and a fourth input end of the processor.

2. The audio interface circuit according to claim 1, wherein the first current limiting circuit is coupled to the third electrode via the first filter circuit, and the second current limiting circuit is coupled to the fourth electrode via the second filter circuit.

3. The audio interface circuit according to claim 1, wherein the first filter circuit includes:

a first resistor;

a first inductor connected with the first resistor in series between the first output end and the third electrode; and a first capacitor coupled between the third electrode and the ground voltage.

4. The audio interface circuit according to claim 1, wherein the second filter circuit includes:

a second resistor;

a second inductor connected with the second resistor in series between the second output end and the fourth electrode; and a second capacitor coupled between the fourth electrode and the ground voltage.

5. The audio interface circuit according to claim 1, wherein the first ground circuit includes:

a first transistor including a first end, a second end for receiving the ground voltage and a control end for receiving the ground enabling signal; and a third resistor coupled between the first electrode and the first end of the first transistor.

6. The audio interface circuit according to claim 1, wherein the audio jack further includes:

a ground electrode for receiving the ground voltage; and a first connection detecting electrode for providing a first detecting signal to a connection detecting end of the processor, wherein the processor provides the ground enabling signal according to the first detecting signal, the first connection detecting electrode and the ground electrode are electrically isolated when an audio connector is not inserted into the audio jack, and the first connection detecting electrode and the ground electrode are electrically connected when the audio connector is inserted into the audio jack.

7. The audio interface circuit according to claim 1, wherein the audio jack further includes:

a second connection detecting electrode for providing a second detecting signal, wherein the processor provides the ground enabling signal according to the second detecting signal, the second connection detecting electrode and the third electrode are electrically connected when a audio connector is not inserted into the audio jack, and the second connection detecting electrode and the third electrode are electrically isolated when the audio connector is inserted into the audio jack.

8. The audio interface circuit according to claim 7, further comprising a voltage conversion circuit coupled to the second connection detecting electrode for receiving the second detecting signal, and coupled to a connection detecting end of the processor to provide a connecting reference signal to the connection detecting end.

9. The audio interface circuit according to claim 8, wherein the voltage conversion circuit includes:

a second transistor including a first end for providing the connecting reference signal, a second end for receiving the ground voltage and a control end for receiving the second detecting signal;

a fourth resistor coupled between a system voltage and the control end of the second transistor; and a third capacitor coupled between the control end of the second transistor and the ground voltage.

10. The audio interface circuit according to claim 7, further comprising:

a second ground circuit coupled between the third electrode and the ground voltage; and a third ground circuit coupled between the fourth electrode and the ground voltage.

11. The audio interface circuit according to claim 10, wherein each of the second ground circuit and the third ground circuit includes a resistor.

12. The audio interface circuit according to claim 10, wherein the second ground circuit is coupled to the third electrode via the first filter circuit, and the third ground circuit is coupled to the fourth electrode via the second filter circuit.

13. The audio interface circuit according to claim 1, wherein when the processor receives a mode setting signal and the mode setting signal corresponds to a headset mode, the processor enables the first output end and the second output end and disables the first voltage output end, the second voltage output end, the third voltage output end, the first input end, the second input end, the third input end and the fourth input end;

when the mode setting signal corresponds to a headset microphone mode, the processor enables the first output end, the second output end, the first voltage output end, the first input end and the second input end, and disables the second voltage output end, the third voltage output end, the third input end and the fourth input end;

when the mode setting signal corresponds to a microphone mode, the processor enables the second voltage output end, the third voltage output end, the third input end and the fourth input end, and disables the first output end, the second output end, the first voltage output end, the first input end and the second input end.

14. The audio interface circuit according to claim 1, wherein each of the third filter circuit and the fourth filter circuit includes a capacitor.

15. The audio interface circuit according to claim 1, wherein each of the first current limiting circuit and the second current limiting circuit includes a resistor.

16. The audio interface circuit according to claim 1, wherein currents through the first current limiting circuit and the second current limiting circuit are less than or equal to a rated current of a headset.

* * * * *